US007517434B2

(12) United States Patent
Ouchi et al.

(10) Patent No.: US 7,517,434 B2
(45) Date of Patent: Apr. 14, 2009

(54) PAPER TRANSPORTING FELT, AND PRESS APPARATUS OF PAPER MACHINE HAVING PAPER TRANSPORTING FELT

(75) Inventors: Takashi Ouchi, Tokyo (JP); Kenji Inoue, Tokyo (JP)

(73) Assignee: Ichikawa Co., Ltd., Tokyo (JP)

( * ) Notice: Subject to any disclaimer, the term of this patent is extended or adjusted under 35 U.S.C. 154(b) by 374 days.

(21) Appl. No.: 11/347,317

(22) Filed: Feb. 6, 2006

(65) Prior Publication Data

US 2006/0175032 A1 Aug. 10, 2006

(30) Foreign Application Priority Data

Feb. 7, 2005 (JP) ..... P.2005-030300

(51) Int. Cl.

| | |
|---|---|
| ***D21F 7/08*** | (2006.01) |
| ***D21F 3/04*** | (2006.01) |
| ***B32B 5/26*** | (2006.01) |
| ***B32B 27/04*** | (2006.01) |

(52) U.S. Cl. ..... 162/358.2; 162/306; 162/358.1; 162/360.2; 162/900; 442/278

(58) Field of Classification Search ..... 162/116, 162/204–207, 306, 348, 358.1, 358.2, 358.3, 162/358.4, 359.1, 360.2, 900–904; 442/242, 442/254, 270, 271, 275, 277, 278, 283
See application file for complete search history.

(56) References Cited

U.S. PATENT DOCUMENTS

| | | | | |
|---|---|---|---|---|
| 4,357,386 | A | 11/1982 | Luciano et al. | 428/234 |
| 4,500,588 | A * | 2/1985 | Lundstrom | 428/212 |
| 4,701,368 | A * | 10/1987 | Kiuchi et al. | 442/226 |
| 4,788,100 | A * | 11/1988 | Janssen et al. | 442/225 |
| 5,232,768 | A * | 8/1993 | Eklund et al. | 442/225 |
| 6,383,339 | B1 * | 5/2002 | Gstrein | 162/358.4 |
| 6,616,814 | B2 * | 9/2003 | Best | 162/358.4 |
| 6,712,940 | B2 * | 3/2004 | Crook | 162/306 |
| 7,306,704 | B2 * | 12/2007 | Hyvonen | 162/358.2 |
| 2005/0042435 | A1 * | 2/2005 | Karlsson et al. | 428/292.1 |

FOREIGN PATENT DOCUMENTS

| | | |
|---|---|---|
| DE | 29700642 U | 6/1998 |
| EP | 0 367 739 | 5/1990 |
| JP | 62-21895 | 1/1987 |
| WO | WO 99/66124 | 12/1999 |
| WO | WO 03/091498 A1 | 11/2003 |

* cited by examiner

*Primary Examiner*—Eric Hug
(74) *Attorney, Agent, or Firm*—Morgan, Lewis & Bockius LLP

(57) ABSTRACT

A paper transporting felt includes a base layer, a first batt layer formed on a wet paper side surface of the base layer, a second batt layer formed on a press side surface of the base layer, a polymer elastic material impregnated in the base layer, the first batt layer and the second batt layer, and a wet paper contacting layer which is formed on a wet paper side surface of the first batt layer so as to come into direct contact with a wet paper, and includes a flexible resin material. The compressibility of the wet paper contacting layer is larger than that of a layer formed of the base layer, the first batt layer and the second batt layer.

6 Claims, 2 Drawing Sheets

PAPER TRANSPORTING FELT, AND PRESS APPARATUS OF PAPER MACHINE HAVING PAPER TRANSPORTING FELT

CROSS-REFERENCE TO RELATED APPLICATIONS

This application is based upon and claims the benefit of priority from the prior Japanese Patent Applications No. 2005-030300, filed on Feb. 7, 2005, the entire contents of which are incorporated herein by reference.

BACKGROUND OF THE INVENTION

1. Field of the Invention

The present invention relates to a paper transporting felt and a press apparatus of a paper machine having the paper transporting felt.

2. Description of the Related Art

Generally, a paper machine includes a wire part, a press part, and a drier part. The wire part, the press part, and the drier part are arranged in that order in a wet paper transporting direction. A wet paper is transported sequentially through wet paper transporting members provided in the wire part, the press part, and the drier part, water is squeezed out of the wet paper in the meantime, and the wet paper is finally dried on a drier canvas (as a paper transporting member) in the drier part. A press apparatus disposed in the press part includes a plurality of press mechanisms arranged in series in the wet paper transporting direction.

Each press mechanism includes a pair of paper transporting felts having an endless belt shape and a pair of rolls (that is, roll press) or a roll and shoe (that is, shoe press) as a press vertically opposite to each other to interpose a part of the pair of paper transporting felts therebetween. By allowing the pair of rolls or the roll and shoe to press the wet paper, which is transported by the paper transporting felts traveling in the same direction at the same speed, along with the paper transporting felt, water is squeezed out of the wet paper and is absorbed by the paper transporting felt. The paper machine is classified into a roll press type paper machine in which a press apparatus interposing and pressing a part of the paper transporting felts, which interpose the wet paper, between a roll and a roll is provided in the press part and a shoe press type paper machine in which a press apparatus interposing and pressing a part of the paper transporting felts, which interpose the wet paper, between a roll and a shoe is provided in the press part. Specifically, since the shoe press type paper machine can have a greater press zone of a pressing portion (that is, a nip) of the press than that of the roll press type paper machine which is used more widely, the pressing time can be more elongated. Accordingly, the shoe press type paper machine can have more excellent dewatering characteristic.

In the paper machine, the wet paper transported by the paper transporting felts of the press apparatus is sequentially transported through the paper transporting felts of a plurality of press mechanisms arranged in series while squeezing out water therefrom and then the surfaces of the wet paper are smoothed. Accordingly, the paper transporting felts should have a function of transporting the wet paper, a function of squeezing water out of the wet paper, a paper separating function of smoothly separating the wet paper from the paper transporting felt for sending the wet paper to a next process (in other words, facilitating the peeling of the wet paper from the paper transporting felts), and a wet paper surface smoothing function of smoothing the surfaces of the wet paper. Specifically, since much water may be squeezed out of the wet paper by the press mechanism disposed on the upstream side in the wet paper transporting direction of the press part, the paper transporting felts of the press mechanism disposed on the downstream side in the wet paper transporting direction require the wet paper surface smoothing function rather than the function of squeezing water out of the wet paper as a more important function.

In a portion covering the center of the pressing portion of the press mechanism to the exit thereof, since a pressure applied to the wet paper and the paper transporting felts is abruptly released, the volumes of the paper transporting felt and the wet paper in the portion are abruptly expanded. As a result, a minus pressure is generated in the paper transporting felts and the wet paper and a capillary phenomenon acts thereon due to micro fibers constituting the wet paper, thereby resulting in a re-wetting phenomenon that the water absorbed by the paper transporting felts is transferred again to the wet paper. In this way, the portion covering the center of the pressing portion to the exit thereof serves as an important factor for deteriorating the dewatering performance of the press apparatus of the paper machine.

As a paper transporting felt for preventing the re-wetting phenomenon of the paper transporting felt and a blowing phenomenon at the time of press, there is known a paper transporting felt which is impregnated with emulsion resin and of which a wet paper side portion has been intensively studied (See U.S. Pat. No. 4,500,588). In the paper transporting felt, more specifically, a barrier layer is formed by impregnating a batt layer formed on the surface of a base layer with the emulsion resin and performing a calender machining to the wet paper side surface of the batt layer into a dense and smooth surface of a chamois leather type, or a rough fiber layer formed on the surface of the base layer is impregnated with the emulsion resin to form a barrier layer (non-woven fiber layer) on the rough fiber layer, and a fine fiber layer is formed on the barrier layer (non-woven fiber layer). Accordingly, since the barrier layer prevents the emulsion resin from reaching the wet paper side surface of the paper transporting felt, it is possible to prevent the re-wetting and the blowing of the paper transporting felt and thus to enhance a papermaking speed. In addition, when the paper transporting felt is pressed along with the wet paper in the pressing portion of the press mechanism, it is possible to reduce a factor of hindering the surface smoothing of the wet paper that air contained in the paper transporting felt is pushed out from the wet paper side surface to roughen the surface of the wet paper.

There is also known a paper transporting felt of which the surface is provided with a liquid impermeable layer (See German Utility Model Application Publication No. DE 29706427 U1). The paper transporting felt has a fiber layer including thermoplastic fibers or melted fibers, and the thermoplastic fibers or the melted fibers are melted by heating the surface of the fiber layer to form the liquid impermeable layer.

Further, there is known a paper transporting felt in which a surface of resin layer which faces the wet paper has an upwardly opened gap (see Patent Document 3). In the paper transporting felt, a plurality of open grooves are formed in the polymer resin layer which faces the wet paper by means of dissolution of solvent-removal materials (more specifically, solvent-removal fibers) in order to improve wear resistance, spacing resistance and compression resistance, so that water permeability is obtained using the gaps formed in the polymer resin layer which faces the wet paper (more specifically, a hardened polymer resin layer) by means of the plurality of open groove.

U.S. Pat. No. 4,500,588, German Utility Model Application Publication No. DE 29706427 U1, and JP-A-62-21895 are referred to as related art.

The paper transporting felts mounted on a plurality of press mechanisms arranged in series have different main functions. The function of squeezing water out of the wet paper is mainly required for the paper transporting felt mounted on the press mechanism disposed on the upstream side in the wet paper transporting direction among the plurality of press mechanisms and the function of smoothing the surface of the wet paper is mainly required for the paper transporting felt mounted on the press mechanism disposed on the downstream side in the wet paper transporting direction. That is, the surface smoothness of the wet paper may mainly depend upon the paper transporting felt mounted on the press mechanism disposed on the downstream side in the wet paper transporting direction among the plurality of press mechanisms. Accordingly, the paper transporting felt mounted on the press mechanism disposed on the downstream side in the wet paper transporting direction among the plurality of press mechanisms should have a smooth surface which faces the wet paper. However, since the wet paper input to the press mechanism disposed on the downstream side in the wet paper transporting direction among the plurality of press mechanisms slightly contains water, it is preferable that the paper transporting felt mounted on the press mechanism disposed on the downstream side should have a dewatering characteristic more or less.

The water contained in the wet paper is absorbed and squeezed out by the paper transporting felt which is compressed and decompressed in the pressing portion of the press mechanism. That is, the paper transporting felts require proper ventilation ability, compression ability, and decompression ability for efficiently squeezing out water.

In a press apparatus of the paper machine, specifically, in a press apparatus of a shoe press type paper machine or a single nip-type paper machine, since a pressing portion (that is, nip) of a press applies a very large pressure to the paper transporting felt to squeeze out water, the batt layer of the paper transporting felt coming into direct contact with the pressing portion of the press can be easily damaged and thus a lifetime of the paper transporting felt (that is, a usable period of time of the paper transporting felt) is short. Accordingly, maintenance for regularly interchanging the paper transporting felt with a new one is required.

Further, in the press apparatus of the paper machine, fibers on the batt layer of the paper transporting felt, which comes into direct contact with the wet paper, remarkably falls out (loss of fiber) or are cut out due to the high pressure and friction by the pressing portion (i.e., nip). Most of the falling out or cut-out fibers are discharged out of the press apparatus by means of a cleaning unit such as a shower and suction box, however, some of the fibers may be stuck to the surface of the wet paper. Because the fibers falling out or cut off are thicker and harder than that of the wet paper, the paper made of the wet paper to which the fibers falling out or cut out are stuck (i.e., paper manufacture) may have poor printability (more specifically, the decolorization may occurs on printing). Accordingly, the quality of the paper products such as printed materials is deteriorated due to the falling out of the fibers from the surface of the batt layer of the paper transporting felts which comes into direct contact with the wet paper. Further, since the surface of the wet paper side batt layer is rough due to the falling out of the fibers, it is a factor which deteriorates the surface smoothness of the wet paper.

However, it is difficult to merely replace the fiber constituting the surface of the batt layer of the paper transporting felt coming into direct contact with the wet paper with a micro fiber. Specifically, when the micro fiber is cut in a process prior to a needling process (a cutting operation is performed prior to the needling process and a fiber webbing sheet after the cutting operation is raised through needling) as one of processes of manufacturing the paper transporting felt, fiber lumps (that is, lumps of fibers) can be easily generated. Accordingly, the fiber lumps are raised from the belt through the needling right after the cutting operation and thus relatively large unevenness is formed on the surface of the paper transporting felt, thereby deteriorating the surface smoothness of the wet paper.

The paper transporting felt of which the wet paper side surface is processed, which is disclosed in U.S. Pat. No. 4,500,588, is a paper transporting felt having an excellent surface smoothness and a water impermeability (that is, ability of allowing water not to pass from the wet paper side surface to the press side surface), but has a poor ability of squeezing water out of a wet paper. Therefore, since a high ability of squeezing water out of the wet paper cannot be expected for the paper transporting felt, it is preferable so as to utilize the paper transporting felt that the dewatering of the wet paper is completely performed by a press mechanism disposed on the upstream side in the wet paper transporting direction. In other words, the paper transporting felt of which the wet paper side surface is subjected to the calender process, which is disclosed in U.S. Pat. No. 4,500,588, can be preferably mounted on a press apparatus disposed on the downstream side in the wet paper transporting direction among a plurality of press mechanisms arranged in series. However, since much thermal energy is required for a heating and drying process in the drier part as a next process, it is important that the water in the wet paper is removed in the press part as much as possible. Therefore, it is more preferable that the paper transporting felt mounted on the press mechanism disposed on the downstream side in the wet paper transporting direction among a plurality of press mechanisms has a function of squeezing water out of the wet paper more or less. The paper transporting felt, which is disclosed in U.S. Pat. No. 4,500,588, in which the non-woven fiber layer is interposed between the rough fiber layer facing the base layer and the micro fiber layer facing the wet paper and having the fiber lumps is not suitable for the press apparatus of the paper machine in which the high ability of squeezing water out of the wet paper is required for the paper transporting felt.

In the paper transporting felt disclosed in German Utility Model Application Publication No. DE 29706427 U1, a liquid impermeable layer is formed by heating the surface of a fiber layer including thermoplastic fibers or melted fibers to melt the thermoplastic fibers or the melted fibers. The paper transporting felt has a feature that the thickness of the liquid impermeable layer can be controlled to some extent by adjusting the amount of heat applied from the surface of the fiber layer. However, since it is necessary to perform the heating within a range not deteriorating the fiber characteristic of the heating surface, that is, the surface of the liquid impermeable layer, by the heating, the depth of the paper transporting felt (that is, the thickness of the liquid impermeable layer) is limited in consideration of the thermal deterioration or thermal decomposition of the thermoplastic fibers or the melted fibers. Accordingly, the thickness of the liquid impermeable layer is automatically limited not to be too thick. In addition, since the wet paper side surface includes a fiber layer, very great pressure or friction is applied to the fiber by the pressing portion and thus the falling-out or cutting-out of fiber (that is, loss of fiber) from the surface of the fiber layer remarkably occurs. The loss of fiber from the surface of the fiber layer coming into direct contact with the wet paper in the paper transporting felt deteriorates the quality of paper products such as print mediums. On the other hand, since the surface of the fiber layer is roughened due to the loss of fiber, the surface smoothness of the wet paper is remarkably lowered.

In the paper transporting felt disclosed in Patent Document 3, because the elongated gaps are formed on the surface of the polymer resin layer which faces the wet paper by means of dissolution of the solvent-removal materials (more specifically, the solvent-removal fibers), there is no variation in the characteristic for squeezing out the water. However, when the used amount of the solvent-removal materials is increased, it may affect the surface smoothness of the wet paper. In addition, since the solvent-removal materials serving as reinforcing materials are removed from the polymer resin layer which faces the wet paper, the compression resistance of the layer, after the materials are dissolved, is deteriorated.

SUMMARY OF THE INVENTION

An object of the present invention is to provide a paper transporting felt which has a smaller damage resulting from the pressing by a press of a press mechanism and which has an excellent durability, a proper dewatering characteristic, and an excellent performance of smoothing the surface of a wet paper, and a press apparatus of a paper machine having the paper transporting felt.

The invention provides a paper transporting felt which is at least one paper transporting felt of a pair of paper transporting felts, which are disposed in a press apparatus provided in a press part of a paper machine, form a press mechanism together with a press in the press apparatus, which are transported while sandwiching a wet paper and pressurized by the press, having: a base layer 11; a first batt layer 13A which is formed on a wet paper side surface of the base layer 11; a second batt layer which is formed on a press side surface of the base layer; a polymer elastic material which is impregnated in the base layer, the first batt layer and the second batt layer; and a wet paper contacting layer which is formed on a wet paper side surface of the first batt layer so as to come into direct contact the wet paper, and which includes a flexible resin material, wherein a compressibility of the wet paper contacting layer is larger than a compressibility of a layer formed by the base layer, the first batt layer and the second batt layer.

In the paper transporting felt, the resin material includes a foaming resin or a hollow particulate resin.

In the paper transporting felt, a difference between the compressibility of the wet paper contacting layer and the compressibility of the layer formed by the base layer, the first batt layer and the second batt layer is more than or equal to 5% under 10 kg/cm$^2$ pressure.

The invention also provides a press apparatus of a paper machine having the above paper transporting felt.

The invention also provides a press apparatus of a paper machine having a plurality of press mechanisms each having the paper transporting felt, in which the plurality of press mechanisms are disposed in series along a transporting direction of the wet paper transported by the paper transporting felts.

In the press apparatus of the paper machine, the above paper transporting felt is provided in a press mechanism disposed on a downstream side in the transporting direction among the plurality of press mechanisms.

The above press apparatus of the paper machine may be a press apparatus of a shoe press type paper machine, in which the press of the press apparatus is a shoe press having a roll and a shoe pressing the paper transporting felt.

The above press apparatus of the paper machine may be a press apparatus of a roll press type paper machine, in which the press of the press apparatus is a roll press having a pair of rolls pressing the paper transporting felt.

In the paper transporting felt, the base layer, the first batt layer and the second batt layer include the polymer elastic material, and the wet paper contacting layer is formed of a flexible resin material. Accordingly, since the base layer, the first batt layer and the second batt layer include the polymer elastic material such as a synthetic resin, the base layer and the second batt layer have a high mechanical strength against the pressing by the press of the press mechanism. Therefore, even when the paper transporting felt is strongly pressed by the pressing portion of the press, the paper transporting felt is less damaged and thus the paper transporting felt has an excellent durability. As a result, since the lifetime of the paper transporting felt is elongated, the frequency of interchanging the paper transporting felt can be reduced. In addition, since the wet paper contacting layer made of a flexible resin material has a larger compressibility than that of a layer formed of the base layer, the first batt layer and the second batt layer, it has a proper compression and decompression ability as compared to a layer formed of the base layer, the first batt layer and the second batt layer, therefore, it is possible to absorb the water from the wet paper. In addition, since the falling out of the fibers from the wet paper contacting layer does not occur at all, the surface smoothness of the wet paper can be improved. Further, since the fibers do not fall out of the wet paper contacting layer, the life cycle of the paper transporting felt (i.e., the available period of the paper transporting felts) can be extended and the frequency of interchange can be reduced.

In the paper transporting felt, since the resin material forming the wet paper contacting layer includes a foaming resin or a hollow particulate resin, the wet paper contacting layer has smooth and porous internal construction. With this, the paper transporting felt is suitably cushioned and capable of squeezing out the water, thereby possibly make the surface of the wet paper smooth.

In the paper transporting felt, since the difference between the compressibility of the wet paper contacting layer of the paper transporting felt and the compressibility of the layer formed by the base layer, the first batt layer and the second batt layer is more than or equal to 5% under 10 kg/cm$^2$ pressure, the wet paper contacting layer has a proper compression and decompression ability. Further, the paper transporting felt is preferably used on downstream of transporting direction of the press apparatus.

The polymer elastic material can be the synthetic resin such as aqueous urethane resin, aqueous acryl resin, aqueous epoxy resin, and aqueous synthetic rubber (that is, aqueous emulsion resin). Such a polymer elastic material is impregnated in the base layer, the first batt layer and the second batt layer, and is then heated and cured.

Since the press apparatus of the paper machine includes a papermaking transporting belt, the excellent operational advantages can be obtained as described above.

In addition, when the press apparatus of the paper machine comprising the plurality of press mechanisms having the above paper transporting felt, the plurality of press mechanisms are disposed in series along the transporting direction of the wet paper transported by the paper transporting felts, the water can be efficiently squeezed out of the wet paper and the surface of the wet paper can be suitably smoothed, thereby enabling the papermaking work at a high speed.

In addition, when the paper transporting felt is provided in the press mechanism disposed on the downstream side in the transporting direction among the plurality of press mechanisms, it can be considered that the water permeability is slightly smaller than that of the paper transporting felt having the smaller content of the polymer elastic material, but since the more excellent function of smoothing the surface of the wet paper, it is possible to enhance the surface smoothness of the wet paper and to enable the papermaking work at a high speed.

In the press apparatus of the show press type paper machine, since a press zone of the pressing portion (that is, a nip formed between the roll and the shoe) is widened by employing the press apparatus of the shoe press type paper machine and thus the pressing time can be elongated, it is possible to improve the dewatering characteristic and to smooth the surface of the wet paper.

In the press apparatus of the roll press type paper machine, it is possible to obtain the same excellent operational advantages described above, even by employing the press apparatus of a roll press type paper machine.

Consequently, it is possible to provide a paper transporting felt which has a smaller damage resulting from the pressing by a press of a press mechanism and which has an excellent durability, a proper dewatering characteristic, and an excellent ability of smoothing the surface of a wet paper, and a press apparatus of a paper machine having the paper transporting felt.

Hitherto, the present invention has been described in brief. The present invention can become clearer by describing the best mode for carrying out the present invention with reference to the accompanying drawings.

DETAILED DESCRIPTION OF THE PREFERRED EMBODIMENTS

An embodiment of the present invention will be described in detail with reference to the accompanying drawings.

Figure 1:
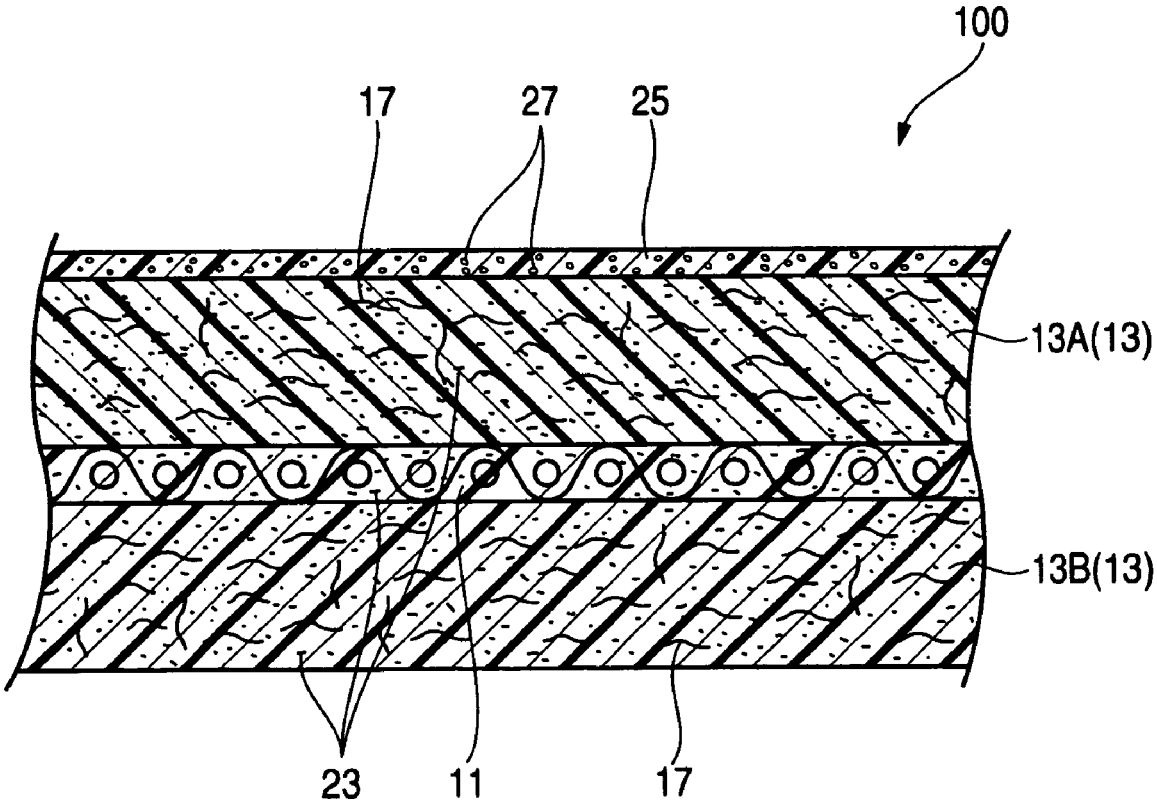
FIG. 1 is a vertical cross-sectional view illustrating a paper transporting felt according to an embodiment of the present invention.
Figure 2:
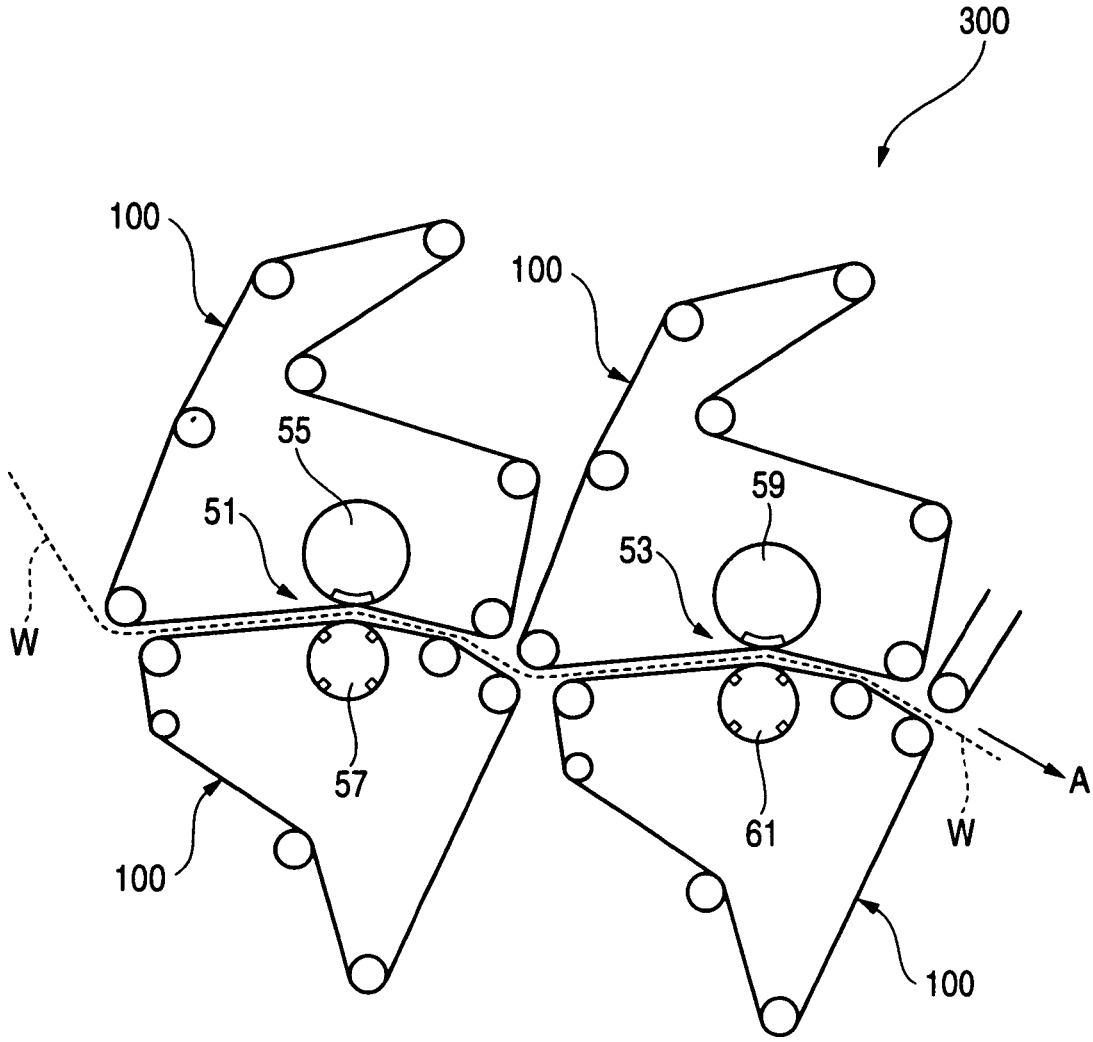
FIG. 2 is a plan view schematically illustrating a structure of a press apparatus of a paper machine according to an embodiment of the present invention.

FIG. 1 is a vertical cross-sectional view illustrating a paper transporting felt (paper transporting felt 100) according to an embodiment of the present invention, and FIG. 2 is a plan view schematically illustrating a paper transporting felt according to an embodiment of the present invention.

As shown in FIG. 1, the paper transporting felt 100 includes a base layer 11, a batt layer 13 (first batt layer 13A and second batt layer 13B), and a wet paper contacting layer 25. More specifically, the first batt layer 13A is formed on the wet paper side surface of the base layer 11, the second batt layer 13B is formed on a press side surface (more specifically, a surface facing one of a pair of rolls or one of a roll and a shoe) of the base layer 11, and the wet paper contacting layer 25 is formed on the wet paper side surface of the first batt layer 13A so that the wet paper contacting layer 25 comes into direct contact with a wet paper. The base layer 11 and the batt layer 13 (the first batt layer 13A and the second batt layer 13B) are entangled with each other through a needling operation to form a body.

The base layer 11 serves to give a strength to the paper transporting felt 100 and can be properly made of a woven cloth composed of a synthetic fiber such as nylon 6 (that is, N6) and nylon 66 (that is, N66) having excellent wear resistance, fatigue resistance, extensibility, and flame resistance or a natural fiber such as wool, a cloth made of a string material overlapped but not woven, or a cloth made into a film shape. In the present embodiment, the woven cloth is used for the base layer 11.

The batt layer 13 (the first batt layer 13A and the second batt layer 13B) is a non-split fiber layer formed out of staple fibers 17 having a size of 6 decitex or more (generally about 17 decitex). The material constituting the batt layer 13 may properly include the same material as the base layer 11. The second batt layer 13B may be omitted depending upon characteristics required for the paper transporting felt 100.

The base layer 11, the first batt layer 13A and the second batt layer 13B include a polymer elastic material 23 in fibers thereof or in a space between the staple fibers 17. Examples of the polymer elastic material 23 can include synthetic resin such as aqueous urethane resin, aqueous acryl resin, aqueous epoxy resin, and aqueous synthetic rubber (that is, aqueous emulsion resin). Such a polymer elastic material 23 is impregnated in the second batt layer 13B, the base layer 11 and the first batt layer 13A by applying the polymer elastic material 23 to the surface of the second batt layer 13B (the bottom surface in FIG. 1) by the use of a roller or a coater blade or spraying the polymer elastic material thereto by the use of a spray, and is then dried and cured by the use of hot wind. Since the base layer 11, the first batt layer 13A and the second batt layer 13B include the polymer elastic material 23, entangling points of fibers constituting the base layer 11, the first batt layer 13A and the second batt layer 13B are coupled to each other with the polymer elastic material 13, thereby stabilizing the shape and enhancing the mechanical strength. That is, even when the paper transporting felt 100 is pressed in a pressing portion of a press mechanism, it is not flattened for a long time and change in density and ventilation with the lapse of time is small to be stable.

The wet paper contacting layer 25 is formed of a flexible resin layer which is formed on the wet paper side surface of the first batt layer 13A. The resin material forming the resin layer is, for example, a resin material including a foaming resin and a hollow microparticulate resin and makes the resin layer flexible. The compressibility of the wet paper contacting layer 25 is larger than that of a portion (layer) of the paper transporting felt 100, which is formed by the base layer 11, the first batt layer 13A and the second batt layer 13B.

More specifically, the compressibility of the wet paper contacting layer 25 is in the range of 25% to 40%, and preferably in the range of 30% to 35%. On the other hand, the portion (layer) of the paper transporting felt 100, which is formed by the base layer 11, the first batt layer 13A and the second batt layer 13B has the compressibility ranging from 20% to 35%, preferably from 25% to 30%.

The compressibility is obtained such that, using a plate press testing machine (not shown), a test piece of the paper transporting felt 100 is pressed at an initial pressure of 2 kg/cm2 and then is pressed up to 10 kg/cm2 pressure, while each thickness of the wet paper contacting layer 25 and the portion (layer) of the paper transporting felt 100, which is formed by the base layer 11, the first batt layer 13A and the second batt layer 13B is measured by an image output from an optical microscope, for each pressure. The compressibility is then obtained by assigning the measured thicknesses to an expression as below. The same tests as the above are carried out for each of a plurality of test pieces of a paper transporting felt 100. Further, the initial pressure is applied to the test piece in the above test, so as to measure the thickness without an error by smoothing the surface of the test piece.

The expression to calculate the compressibility is as follows.

$$\text{Compressibility}(\%)=(t1-t2/t1)\times 100$$

(where t1 is the thickness of the test piece under 10 kg/cm$^2$ pressure, and t2 is the thickness of the test piece under the initial pressure of 2 kg/cm$^2$)

Further, in the above test, even though the test piece from the paper transporting felt 100 itself is used as a test piece, it is difficult to measure the individual thicknesses of the wet paper contacting layer and the portion (layer) in the paper transporting felt 100, which is formed by the base layer 11, the first batt layer 13A and the second batt layer 13B. More specifically, it is difficult to obtain the test pieces having uniform thicknesses, respectively, for the wet paper contacting layer 25 and the portion (layer) of the paper transporting felt 100, which is formed by the base layer 11, the first batt layer 13A and the second batt layer 13B, from just slicing the paper transporting felt 100.

The foaming resin is formed by bubbling, for example, an aqueous urethane resin, an aqueous acryl resin and an aqueous epoxy resin or by mixing a foaming agent in the resin to mix a plurality of microscopic air bubbles with the resin. The wet paper contacting layer 25 contains a plurality of microscopic air bubbles 27, thereby having high flexibility and smooth surfaces.

The resin including the hollow microparticulate resin is formed by mixing a hollow microparticulate resin such as thermal expansive microcapsules in the resin including an aqueous urethane resin, aqueous acryl resin and aqueous epoxy. The thermal expansive microcapsules are microscopic plastic spheres (for example, the average diameter is 10 to 17 μm) that are generated by polymer shell containing liquid gas, and are hollow spherical particles of which the volume increases 40 times by heating at 80 to 190° C. Accordingly, the wet paper contacting layer 25 has a plurality of air bubbles 27. The wet paper contacting layer 25 containing the thermal expansive microcapsules has improved flexibility, surface smoothness and dimensional stability. "EXPANCEL" (trade mark; made by Japan ferrite Co., Ltd.) is given as a specific example of the thermal expansive microcapsule.

Measuring basic weights of respective elements of a typical example of the paper transporting felt 100 having the above-mentioned structure, the base weight of the wet paper contacting layer 25 is 200 g/m$^2$, the basic weight of the first batt layer 13A is 400 g/m$^2$, the basic weight of the base layer 11 is 650 g/m$^2$, and the basic weight of the second batt layer 13B is 100 g/m$^2$. The polymer elastic material 23 is impregnated in the base layer 11, the first batt layer 13A and the second batt layer 13B by 5 wt %, respectively, and is not impregnated in the wet paper contacting layer 25.

Measuring basic weights of respective elements of a light-weighted example of the paper transporting felt 100 are that the base weight of the wet paper contacting layer 25 is 100 g/m$^2$, the basic weight of the first batt layer 13A is 200 g/m$^2$, the basic weight of the base layer 11 is 200 g/m$^2$, and the second batt layer 13B is omitted. The polymer elastic material 23 is impregnated in the base layer 11 and the first batt layer 13A by 1 wt % and is not impregnated in the wet paper contacting layer 25.

Measuring basic weights of respective elements of a heavy-weighted example of the paper transporting felt 100, the base weight of the wet paper contacting layer 25 is 300 g/m$^2$, the basic weight of the first batt layer 13A is 800 g/m$^2$, the basic weight of the base layer 11 is 1500 g/m$^2$, and the basic weight of the second batt layer 13B is 300 g/m$^2$. The polymer elastic material 23 is impregnated in the base layer 11, the first batt layer 13A and the second batt layer 13B by 10 wt %, respectively, and is not impregnated in the wet paper contacting layer 25.

A method of manufacturing the paper transporting felt 100 will be briefly described. Firstly, a woven base layer 11 is integrally formed with a batt layer 13 on both surfaces thereof, through a needling operation, etc. In the case of using a foaming resin for forming the wet paper contacting layer 25, the wet paper contacting layer 25 (i.e., a resin layer) is formed by coating a foaming resin onto the wet paper side surface of the first batt layer 13A and then drying it. Meanwhile, in the case of using a resin including thermal expansive microcapsules for forming the wet paper contacting layer 25, the wet paper contacting layer 25 (i.e., a resin layer) is formed by coating the resin including the thermal expansive microcapsules onto the wet paper side surface of the first batt layer 13A, expanding the thermal expansive microcapsules by heating and drying it.

Next, the polymer elastic material 23 is impregnated in the second batt layer 13B, the base layer 11 and the first batt layer 13A by applying the polymer elastic material 23 to the surface of the second batt layer 13B (the bottom surface in FIG. 1) by the use of a roller or a coater blade or spraying the polymer elastic material thereto by the use of a spray, and is then heated and cured by the use of hot wind. The amount of the polymer elastic material 23 impregnated in the base layer 11, the first batt layer 13A and the second batt layer 13B is properly selected depending upon the characteristic required for the press mechanism fitted with the paper transporting felt 100.

As a result, the base layer 11, the first batt layer 13A and the second batt layer 13B having an excellent durability and a small compression and decompression ability and the wet paper contacting layer 25 having a compression and decompression ability greater than that of the base layer 11, the first batt layer 13A and the second batt layer 13B are formed.

In order to obtain the paper transporting felt 100 having the optimal characteristic for the kind of paper to be made, the respective kind of fibers forming the base layer 11 and the batt layer 13, the kind and the amount of the resin material forming the wet paper contacting layer 25, and the kind and the impregnated amount of the polymer elastic material 23 is properly selected in consideration of the characteristics about each case or the combination thereof.

Next, a press apparatus 300 of a paper machine (shoe press type paper machine) fitted with the paper transporting felt 100 having an endless belt shape (ring shape) will be described with reference to FIG. 2.

As shown in FIG. 2, the press apparatus 300 a so-called closed draw-type press apparatus 300 in which two mechanisms of a first press mechanism 51 and a second press mechanism 53 are arranged in series in the transporting direction of the wet paper W (direction indicated by an arrow A). By employing the closed draw type paper machine in which the wet paper W is transported and pressed in the state where it is interposed between two pairs of paper transporting felts 100, it is possible to stably transport the wet paper W at a high speed of 1200 to 1400 m/min. Accordingly, it is possible to make paper with much higher efficiency compared with the open draw type paper machine.

The first press mechanism 51 includes a pair of paper transporting felts 100 and a first shoe 55 and a first roll 57 (in other words, first shoe press) which are opposed to each other to form a first nip (in other words, first pressing portion)

therebetween. The second press mechanism 53 includes a pair of paper transporting felts 100 and a second shoe 59 and a second roll 61 (in other words, second shoe press) which are opposed to each other to form a second nip (in other words, second pressing portion) therebetween.

As shown in FIG. 2, the paper transporting felts 100 can be employed as the upper and lower paper transporting felts of the first press mechanism 51 and the second press mechanism 53, respectively, but may be employed as any one of the upper and lower paper transporting felts of the first press mechanism 51 and the second press mechanism 53. When the paper transporting felt 100 is mounted as any one of the upper and lower paper transporting felts of the first press mechanism 51 and the second press mechanism 53, any paper transporting felt may be employed as the other paper transporting felts, depending upon the papermaking characteristics. Further, generally, paper transporting felts having a surface smoothing ability rather than a dewatering characteristic are employed as a pair of paper transporting felts mounted on the second press mechanism 53 disposed on the downstream side. Therefore, it is preferable that the pair of the paper transporting felts 100 be employed as the paper transporting felts of the second press mechanism 53.

As shown in FIG. 2, the wet paper W which is delivered from a wire part (not shown) to the first press mechanism 51 is interposed and transported between a pair of paper transporting felts 100, the water is squeezed out of the wet paper by pressing the wet paper with the first shoe 55 and the first roll 57, and the squeezed water is absorbed into the wet paper contacting layer 25 of the paper transporting felt 100. Next, the wet paper W is delivered to the second press mechanism 53 and interposed and transported between a pair of paper transporting felts 100, the water is further squeezed out of the wet paper by pressing the wet paper with the second shoe 59 and the second roll 61, and then the squeezed water is absorbed into the wet paper contacting layer 25 of the paper transporting felts 100.

The wet paper contacting layer 25 of the paper transporting felt 100 is formed of a flexible resin material and the surface which faces the wet paper thereof is dense and flat. Accordingly, the wet paper W having the flat surface is formed, is delivered to a drier part (not shown), and is then dried therein. Since the second batt layer 13B, the base layer 11 and the first batt layer 13A of the paper transporting felt 100 coming in contact with the pressing portions between the first shoe 55 and the first roll 57 or between the second shoe 59 and the second roll 61 include the polymer elastic material 23 and thus the mechanical strengths thereof are enhanced, they are not damaged from the strong pressing in the pressing portions. Therefore, the paper transporting felts have an excellent durability.

As described above, the press apparatus 300 of a shoe press type paper machine having two-stage press mechanisms 51 and 53 has been described as an example of the press apparatus of a paper machine according to the present invention, but the present invention can be applied to a press apparatus having one press mechanism or a press apparatus having a plurality of press mechanisms arranged in series, of course.

Here, for the purpose of more easily understanding the present invention, a configuration of the paper transporting felt according to an embodiment of the present invention and a configuration of the press apparatus of the paper machine having the paper transporting felt will be described in brief.

The paper transporting felt 100 is a paper transporting felt which is at least one paper transporting felt of a pair of paper transporting felts, which are disposed in a press apparatus 300 provided in a press part of a paper machine, form a press mechanism 51 or 53 together with a press (roll 57 or 61 and shoe 55 or 59) in the press apparatus, which are transported while sandwiching a wet paper and pressurized by the press. The paper transporting felt 100 includes a base layer 11; a first batt layer 13A which is formed on a wet paper side surface of the base layer 11; a second batt layer 13B which is formed on a wet paper side surface of the base layer 11; a polymer elastic material 23 which is impregnated in the base layer 11, the first batt layer 13A and the second batt layer 13B; and a wet paper contacting layer 25 which is formed on a wet paper side surface of the first batt layer 13A so as to come into direct contact with the wet paper W, and which has a flexible resin material. The compressibility of the wet paper contacting layer 25 is larger than the compressibility of the layer formed by the base layer 11, the first batt layer 13A and the second batt layer 13B.

Further, the flexible resin material of the wet paper contacting layer 25 includes a foaming resin or a particulate resin.

Furthermore, the difference of the compressibility of the wet paper contacting layer 25 and the compressibility of the layer formed by the base layer 11, the first batt layer 13A and the second batt layer 13B is preferably more than or equal to 5% under 10 kg/cm$^2$ pressure.

The press apparatus 300 includes a plurality of press mechanisms having the paper transporting felt 100 and the plurality of press mechanisms 51 and 53 are arranged in series in the wet paper transporting direction A in which the wet paper is transported by the paper transporting felt 100.

As described above, according to the paper transporting felt 100, the base layer 11, the first batt layer 13A and the second batt layer 13B include the polymer elastic material 23 and the wet paper contacting layer 25 is formed of the flexible resin material. Accordingly, since the base layer 11, the first batt layer 13A and the second batt layer 13B include the polymer elastic material 23 such as a synthetic resin, the base layer and the second batt layer have a high mechanical strength against the pressing by the presses of the press mechanisms 51 and 53. Therefore, even when the paper transporting felt 100 is strongly pressed by the pressing portions of the presses, the paper transporting felt is less damaged and thus the paper transporting felt has an excellent durability. As a result, since the lifetime of the paper transporting felt 100 elongated, the frequency of interchanging the paper transporting felt 100 can be reduced. In addition, since the wet paper contacting layer 25 made of a flexible resin material has a larger compressibility than that of the layer made of the base layer 11, the first batt layer 13A and the second batt layer 13B, and has a proper compression and decompression ability as compared to the layer made of the base layer 11, the first batt layer 13A and the second batt layer 13B, it is possible to absorb the water from the wet paper. Moreover, since the falling out of the fibers from the wet paper contacting layer 25 does not occur at all, the surface smoothness of the wet paper can be improved. Further, as described above, since the fibers do not fall out of the wet paper contacting layer 25, the life cycle of the paper transporting felt 100 (i.e., the available period of the paper transporting felts 100) can be extended and the frequency in interchange can be reduced.

In addition, the paper transporting felt 100 has a proper compression and decompression ability because the difference between the compressibility of the wet paper contacting layer 25 and the compressibility of the layer made of the base layer 11, the first batt layer 13A and the second batt layer 13B is more than or equal to 5% under 10 kg/cm$^2$ pressure.

According to the press apparatus 300 of a paper machine, when a plurality of press mechanisms 51 and 53 having the paper transporting felt 100 are arranged in series in the wet paper transporting direction in which the wet paper W is transported by the papermaking transporter belts 100, the water can be efficiently squeezed out of the wet paper W and the surface of the wet paper can be suitably smoothed, thereby enabling the papermaking work at a high speed. When a paper transporting felt 100 is provided in the press mechanism 53 disposed on the downstream side in the wet paper transporting direction in which the wet paper W is transported by the paper transporting felt 100 among the plurality of press mechanisms 51 and 53, it can be considered that the water permeability is slightly smaller than that of the paper transporting felt having the smaller content of the polymer elastic material 23, but since the more excellent function of smoothing the surface of the wet paper, it is possible to enhance the surface smoothness of the wet paper W and to enable the papermaking work at a high speed. In addition, since the paper transporting felt 100 has a dewatering function, the paper transporting felt can absorb the water out of the wet paper W and can deliver the wet paper to the drier part in which a next process is performed, thereby reducing the thermal energy consumption in the drying process using hot wind, even when the paper transporting felt is mounted on the press mechanism 53 disposed on the downstream side.

The present invention is not limited to the embodiments described above, but may be properly modified and changed in form. Otherwise, materials, shape, measurements, numerical values, types, numbers, arrangement positions, and the like of the respective elements in the embodiments described above may be arbitrary and not limited, only if they can implement the present invention.

For example, when the paper transporting felt according to the present invention is mounted on a press apparatus of a shoe press type paper machine with an open draw type having a portion where the wet paper W is independently transported during transporting, the same advantages can be effectively obtained. In addition, when the paper transporting felt according to the present invention is mounted on a press apparatus of a roll press type paper machine with a closed draw type or an open draw type, the excellent operational advantages of the present invention described above can be obtained.

What is claimed is:

1. A paper transporting felt which is at least one paper transporting felt of a pair of paper transporting felts, which are disposed in a press apparatus provided in a press part of a paper machine, form a press mechanism together with a press in the press apparatus, which are transported while sandwiching a wet paper and pressurized by the press, comprising:

a base layer;

a first batt layer which is formed on a wet paper side surface of the base layer;

a second batt layer which is formed on a press side surface of the base layer;

a polymer elastic material which is impregnated in the base layer, the first batt layer and the second batt layer; and a wet paper contacting layer which is formed on a wet paper side surface of the first batt layer so as to come into direct contact with the wet paper, and which comprises a flexible resin material, wherein a compressibility of the wet paper contacting layer is larger than a compressibility of a layer formed by the base layer, the first batt layer and the second batt layer.

2. The paper transporting felt according to claim 1, wherein the flexible resin material includes a foaming resin or a hollow particulate resin.

3. The paper transporting felt according to claim 1, wherein a difference between the compressibility of the wet paper contacting layer and the compressibility of the layer formed by the base layer, the first batt layer and the second batt layer is more than or equal to 5% under 10 $kg/cm^2$ pressure.

4. A press apparatus of a paper machine comprising the paper transporting felt according to claim 1.

5. A press apparatus of a paper machine comprising a plurality of press mechanisms each having the paper transporting felt according to claim 1, wherein the plurality of press mechanisms are disposed in series along a transporting direction of the wet paper transported by the paper transporting felts.

6. The press apparatus of a paper machine according to claim 5, wherein the paper transporting felt is provided in a press mechanism disposed on a downstream side in the transporting direction among the plurality of press mechanisms.

* * * * *